US005929399A

United States Patent [19]

Jamieson et al.

[11] Patent Number: 5,929,399

[45] Date of Patent: Jul. 27, 1999

[54] AUTOMATIC OPEN LOOP FORCE GAIN CONTROL OF MAGNETIC ACTUATORS FOR ELEVATOR ACTIVE SUSPENSION

[75] Inventors: Eric K. Jamieson, Farmington; Thomas He, Unionville; Daniel S. Williams, Meridan, all of Conn.

[73] Assignee: Otis Elevator Company, Farmington, Conn.

[21] Appl. No.: 09/136,195

[22] Filed: Aug. 19, 1998

[51] Int. Cl.[6] ..... B66B 1/34; B66B 7/04

[52] U.S. Cl. ..... 187/391; 187/292; 361/143

[58] Field of Search ..... 187/292, 409, 187/391; 361/143, 144

[56] References Cited

U.S. PATENT DOCUMENTS

| | | | |
|---|---|---|---|
| 4,841,184 | 6/1989 | Chen et al. | 310/90.5 |
| 4,899,852 | 2/1990 | Salmon et al. | 187/1 R |
| 5,086,882 | 2/1992 | Sugahara et al. | 187/95 |
| 5,294,757 | 3/1994 | Skalski et al. | 187/115 |
| 5,329,077 | 7/1994 | Skalski et al. | 187/133 |
| 5,367,132 | 11/1994 | Skalski et al. | 187/393 |
| 5,368,132 | 11/1994 | Hollowell et al. | 187/393 |
| 5,373,123 | 12/1994 | Skalski | 187/393 |
| 5,379,864 | 1/1995 | Colby | 187/393 |
| 5,467,243 | 11/1995 | Skalski | 361/143 |
| 5,490,577 | 2/1996 | Yoo | 187/252 |
| 5,524,730 | 6/1996 | Roberts | 187/292 |
| 5,535,853 | 7/1996 | Skalski | 187/410 |
| 5,597,988 | 1/1997 | Skalski | 187/393 |
| 5,617,023 | 4/1997 | Skalski | 324/207.17 |
| 5,864,102 | 1/1999 | Jamieson et al. | 187/292 |
| 5,866,861 | 2/1999 | Rajamani et al. | 187/292 |

FOREIGN PATENT DOCUMENTS 0467673 1/1992 European Pat. Off. .

*Primary Examiner*—Robert E. Nappi

[57] ABSTRACT

Automatic gain control is provided for a control means for controlling a magnetic actuator for an elevator horizontal active suspension. The gain is varied depending on the drive current in the coil of the electromagnet of the magnetic actuator, the airgap of the magnetic actuator, or both.

3 Claims, 7 Drawing Sheets

AUTOMATIC OPEN LOOP FORCE GAIN CONTROL OF MAGNETIC ACTUATORS FOR ELEVATOR ACTIVE SUSPENSION

BACKGROUND OF THE INVENTION

1. Technical Field of the Invention

The invention relates to elevator active suspensions and, more particularly, to control of magnetic actuators.

2. Discussion of Related Art

It is known from U.S. Pat. No. 5,439,075, for example, to control horizontal motions of an elevator car guided vertically along hoistway rails by means of an active suspension system. The guiding means can be provided in the form of roller clusters at the corners of the car for engaging the hoistway rails on opposite walls of the hoistway. Horizontal acceleration of the elevator car and horizontal displacement between the car and the rail is sensed for controlling the horizontal motions by means of actuators of the active suspension system. Each roller cluster may include one or more actuators with associated springs wherein the roller cluster actuators are responsive to a controller for actuating the elevator car horizontally with respect to the associated hoistway rail.

A controller shown in FIG. 20 of the above mentioned U.S. patent includes a summer responsive to a force command signal and to a force feedback signal for providing a force error signal to a proportional-plus-integral gain compensator. The compensator in turn provides a current command signal to a current driver which provides current to a coil of an electromagnet actuator of the active suspension. This current in the coil is sensed by a sensor and provided along with a sensed magnetic flux signal to a signal processor for providing a signal indicative of the size of an airgap between the electromagnet and an iron reaction plate. Another signal processor, i.e., a flux-to-force converter, is responsive to the sensed magnetic flux signal for providing the force feedback signal (which is simply related to the square of the flux) to the summer.

As can be seen at column 17, lines 63–66 and the proportional gain of the compensator 486 of FIG. 20 of the above-mentioned U.S. patent, is a constant. Unfortunately, the output force characteristic of an electromagnet actuator is a doubly non-linear function of current and gap. Consequently, the open loop gain of such a force loop varies tremendously over the operational ranges of current and gap and can cause instabilities at the extremes. The performance of the force loop is thereby limited to worst-case gain considerations.

SUMMARY OF INVENTION

An object of the present invention is to allow the achievement of a higher system gain and thereby better performance of a control loop for an electromagnet actuator for an elevator active suspension. Another object is to extend operational magnet airgap ranges while avoiding instabilities in system operation.

According to the present invention, a control for controlling a magnetic actuator for an elevator active suspension, wherein the magnetic actuator is responsive to a drive current from a magnet driver in response to a magnet command signal from the control, wherein the control is responsive to a force command signal, a sensed magnetic flux signal indicative of magnetic flux in an airgap of the magnetic actuator and to a sensed drive current signal for providing the magnet command signal, comprises: a summer, responsive to a force feedback signal having a magnitude indicative of force exerted by the magnetic actuator and responsive to the force command signal, for providing a force error signal; a compensator, responsive to the error signal and to an automatic gain control signal, for providing the magnet command signal; an automatic gain control, responsive to the force feedback signal and to the sensed drive current signal, for providing the automatic gain control signal; and a flux-to-force converter, responsive to the sensed magnetic flux signal, for providing the force feedback signal.

In further accord with the present invention, the compensator includes an adaptive proportional gain which is reduced as the sensed drive current signal increases in magnitude.

In still further accord with the present invention, the automatic gain control means is also responsive to the force feedback signal or to the sensed magnetic flux signal for providing a gap signal having a magnitude indicative of the magnitude of the airgap, wherein the adaptive proportional gain is increased as the gap signal increases in magnitude.

These and other objects, features and advantages of the present invention will become more apparent in light of the detailed description of a best mode embodiment thereof, as illustrated in the accompanying drawings.

DETAILED DESCRIPTION OF PREFERRED EMBODIMENTS

Figure 2:
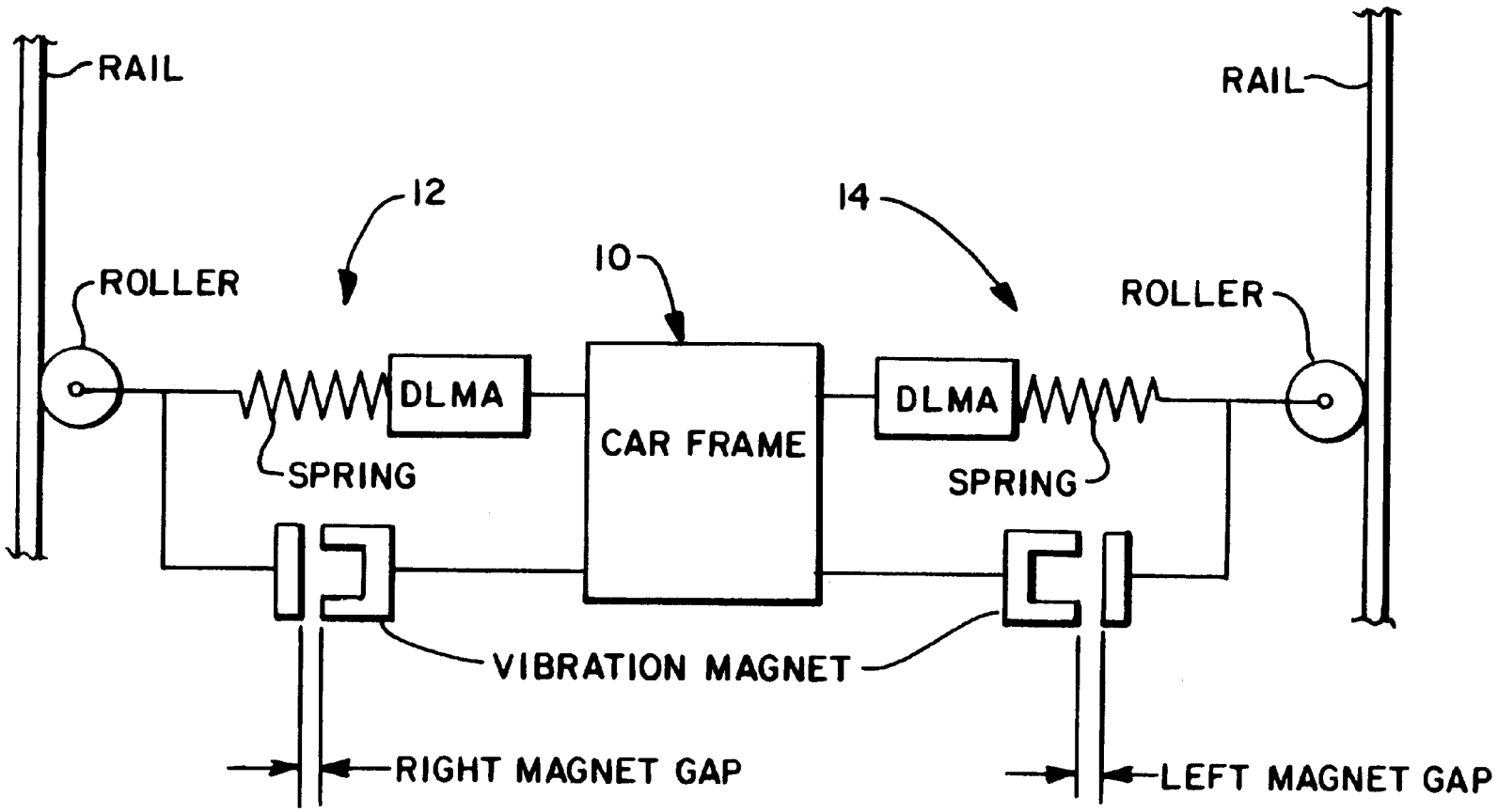
FIG. 2 is a mechanical schematic block diagram of a single, side-to-side axis of control for an active roller guide horizontal suspension.

FIG. 2 shows an elevator car frame 10 suspended to horizontally in the side-to-side axis by a pair of opposed active roller guides 12, 14. Not shown are the left front-to-back and right front-to-back control axis, which have identical (from the standpoint of control) hardware. Each active roller guide includes a roller for engaging an associated hoistway rail and attached to a spring in series, for example, with a digital linear magnetic actuator (DLMA) and in parallel with a vibration supressing electromagnet. The invention is not limited to the particular active roller guide configuration shown in FIG. 2, since other configurations are known and it should be understood that the invention is applicable to them as well. The function of the active roller guide suspension is to both keep the car frame horizontally "centered" in the hoistway, and to suppress horizontal vibrations of the car.

Figure 1:
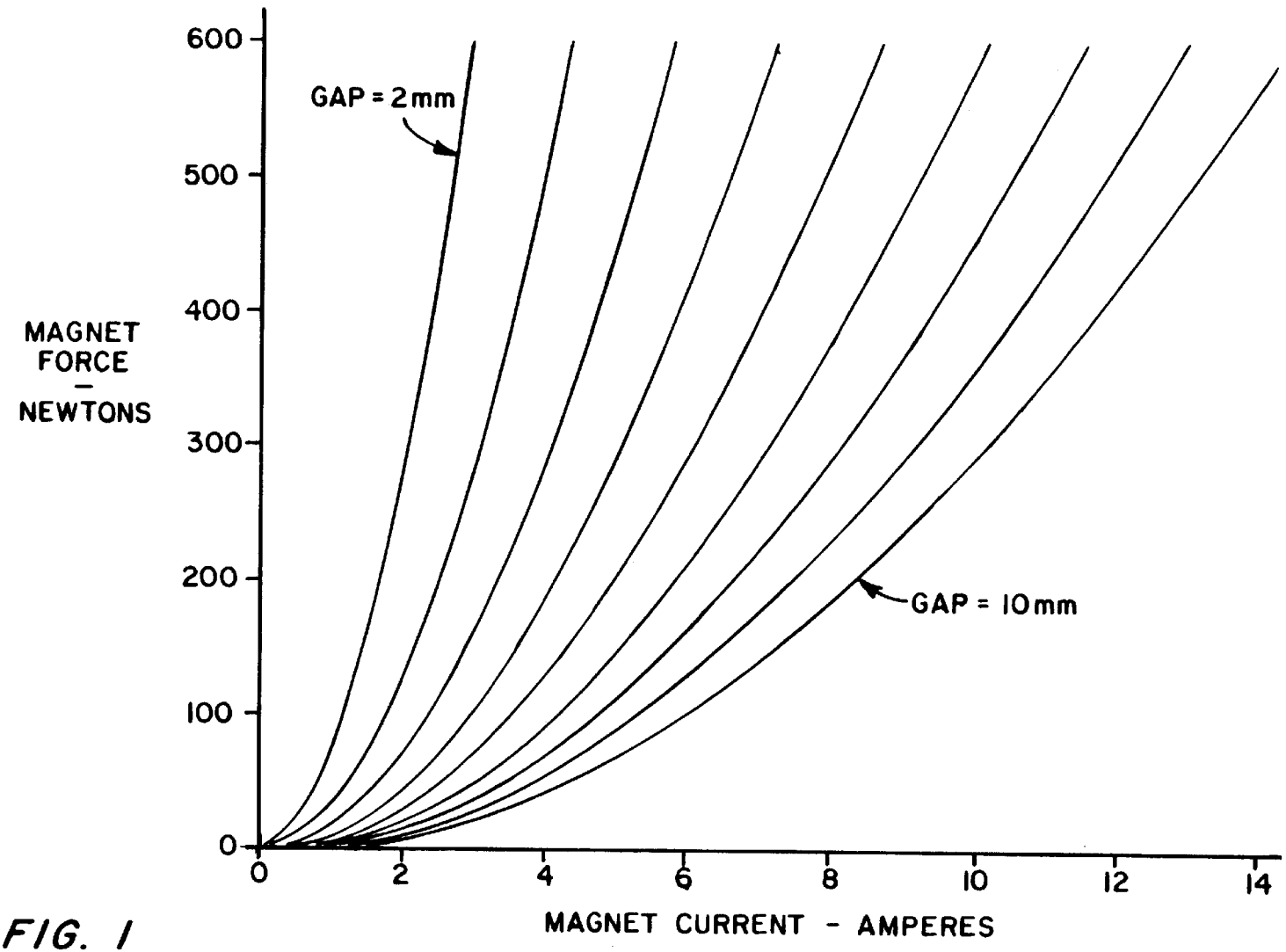
FIG. 1 shows a family of characteristic electromagnet current vs. force curves at 1 mm increments of airgap for an active roller guide horizontal suspension.

FIG. 1 is an illustration of the non-linear characteristics of the electromagnets used in an active roller guide (ARG) for an elevator horizontal suspension of the prior art. As shown, the output force characteristic of the electromagnet is a doubly non-linear function of current and gap. Consequently, the open loop gain of any force control loop for controlling the active roller guide is dependent on the operating conditions of the electromagnet, where the "slope" of the force/current characteristic changes with gap and current.

Any such control means for the magnet force must provide an effective control voltage for the electromagnet coil. The electromagnet coil current resulting from the control voltage is a function of the electromagnet inductance and resistance. The curves in FIG. 1 were computed based on an 850 turn, 2 $in^2$ core cross section magnet, based on the following equation:

$$Fmag=K_f i^2/g^2;$$

where i is the magnet current in Amps g is the magnet gap in meters.

The constant "$K_f$" is a gap conversion factor and is a fixed function of the magnet design.

As can be seen from the curves of FIG. 1, at extreme operating gaps, the maximum force which can be generated at large magnet gap is about 250 N before the 10 A current limit is reached. At the opposite extreme, assuming that the magnet is idling at 1 A (a typical constant ARG value) and the gap is 2 mm, then the idling force will be in excess of 250N. This presents an awkward operational situation since the magnets oppose each other (they are unipolar force generators): this would be a "lockup" configuration which the control could not break out of.

This lockup condition cannot be resolved by simply reducing the magnet idling current for two reasons. First, reducing the idling current in the magnet results in more delay when the magnet is activated, since the current has to be slewed up to several amps at nominal gaps before significant force is developed. Secondly, the control uses flux feedback in conjunction with current feedback to calculate the lateral position of the car for use in "centering" control. Thus, if a fixed low idling current were used, then at large gaps the flux feedback would be too small for reliable position calculation.

Figure 3:
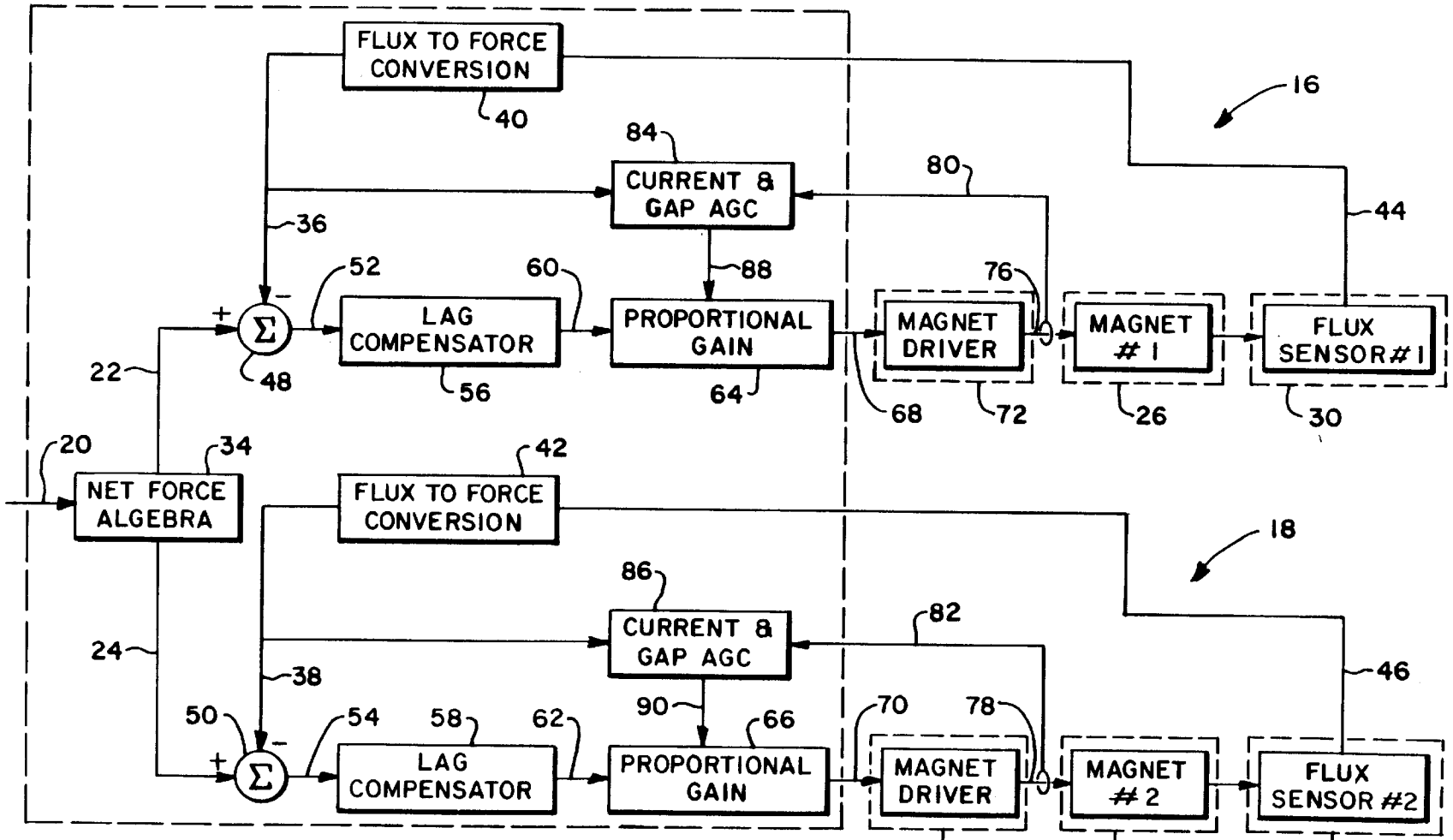
FIG. 3 is a schematic block diagram of a dual force control loop for controlling the suspension of FIG. 2, according to the invention.

Hence, the concept of idling current is abandoned, and the concept of idling force is introduced into the control. As shown in FIG. 3, this concept requires the use of two force loops 16, 18 for control, one for each magnet. Depending on the polarity of a "Net_Force" dictation signal on a line 20, a "Net_Force_1" signal on a line 22 and "Net_Force_2" signal on a line 24, for each loop is set to either "MinimumForce Cmd" or abs("Net_Force")+"MinimumForceCmd". Thus, the net force resulting from the output of both magnets 26, 28 taken together is just "Net_Force", assuming that the closed loop gain of the dual force loops is essentially 1.

One effect of this approach is that the actual idling current in the magnet is not controlled, since force is controlled and gap is not controlled. If the idling force is set too high, excessive idling currents will be generated at large gaps; if the idling force is set too low, then idling currents can be very low at small gaps, which increases the time it takes to slew the magnets up to high force. According to the embodiment of the present invention described above, it has been determined by experimentation that an idling force between 20 and 50 N is the best compromise between excessive idling current and slew rate problems, as evidenced by crossover distortion.

Referring back to FIG. 2, not shown are the flux sensors 30, 32 of FIG. 3 but these are mounted inside the magnet airgaps for magnets 26 and 28. The flux sensors 30, 32 are Hall Effect devices which are used to sense the flux intensity within the airgaps of the vibration magnets. The force exerted by the magnet on its reaction bar is proportional to the square of the flux density which is sensed by the flux sensors. Thus, the flux sensing of the software force control loop is conditioned and used as flux force feedback for the dual force control loops. As shown in FIG. 2, the car frame is suspended laterally with respect to the rails by means of spring suspension. The controller uses the DLMAs to bias the spring suspension to effect the above-mentioned "centering" of the car with respect to the rails. This control is provided so that the working stroke of the magnets is maximized. Another way of rationalizing the centering control requirement is to imagine that the car is perfectly stabilized in an inertial sense: centering control then permits maximum rail deviations even in the presence of imbalance loads on the car frame. Position information is derived by sensing the current in the magnets, the flux in the magnets and solving for the gaps in the magnet according to the equation above, where the Flux Force is equal to FMag:

$$F_{mag} \sim B^2$$

The proportionality constant is a function of the magnet design:

$$F_{mag}=(B^2/2\mu_o)A;$$

where B is the flux density in the gap of the magnet, $\mu_o$ is the permeability of free space ($4\pi\times10^{-7}$ H/m), and A is the total area of the pole faces of the magnet.

For a fixed magnet design, the constant ($A/2\mu_o$) we refer to as the "Flux_Force_Factor". The flux is sampled, converted to force ($F_{mag}$), and plugged into the first equation $$F_{mag}=K_f i^2/g^2;$$

to solve for the gap, g.

Referring back to FIG. 3, according to the present invention, it illustrates a control block diagram of a dual automatic gain control (AGC) force loop. The "Net_Force" dictation command signal on the line 20 is algebraically split by a "Net Force Algebra" block 34 into a "Net_Force_1" signal on the line 22 and a "Net_Force_2" signal on the line 24, as described above. A "Flux_Force_1" feedback signal on a line 36 and a "Flux_Force_2" feedback signal on a line 38 are derived by means of flux-to-force conversion blocks 40, 42 from sensed flux 25 signals 44, 46 from the flux sensors 30, 32, respectively. The signals on the lines 36, 38 are applied as negative feedback at two summers 48, 50. Respective error output signals on lines 52, 54 of the summers 48, 50, "Force_Error_1" and "Force_Error_2", are applied as inputs to respective compensation filters 56, 58 which may include an integrator. A respective output (filtered force error) signal on lines 60, 62 of each compensator is multiplied in a respective block 64, 66 by a proportional gain factor which, according to the present invention, is variable as a function of current and gap conditions for the magnet in question (further detail provided below). Respective magnet command signals on lines 68, 70 are outputs of the force loop regulator and are applied as PWM signals to respective magnet driver power electronics 72, 74. Resulting currents on lines 76, 78 in the magnet coils are sensed and fed back as sensed coil current signals on lines 80, 82 and in a respective "Current & Gap AGC" block 84, 86 used to provide AGC (proportional) gain adjustment signals on lines 88, 90 to the blocks 64, 66 based on the sensed coil current level signals 80, 82 and the flux feedback signals 36, 38, as shown, or based on the sensed flux signals 44, 46 directly. By means of the AGC gain adjustment signals, the blocks 84, 86 cause the proportional gain to be reduced as the respective sensed drive current signal increases in magnitude. These blocks also determine the magnitude of the airgap (e.g. by solving for "g" in the last equation) in the respective magnets in response to the sensed current and force signals and increase the respective proportional gain as the respective argap increases in magnitude. As mentioned before, the magnet currents create flux in the magnet airgaps which are detected by the flux sensors 30, 32 and also fed back to the software control for the flux-to-force computation 40, 42. It should be realized that the determination of the respective airgap magnitudes in blocks 84, 86 could be made (in conjunction with the sensed current signals 80, 82) based directly on sensed flux density on lines 44, 46, rather than force feedback signals 36, 38, as shown.

The calculation of AGC_Gain does not actually linearize the open loop gain of the force loop, but does help to stabilize the loop over a wide range of current gap conditions. First, the proportional gain term used in each force loop is derated as a linear function of the operating current. As the current increases from its minimum, the gain is reduced. Secondly, the proportional gain term used is derated or boosted as a linear function of the magnet gap, as the magnet gap drops below or above 8 mm, respectively. The 8 mm is simply a scheduling factor that was empirically determined for this example. The AGC gain leveling calculations are performed for each force loop by means of the following equations:

$$AGC_Gain1=Gain(1\ A)/I_{mag};$$

and $$AGC_Gain2=AGC_Gain1(gap(mm))/8\ mm.$$

Figure 6:
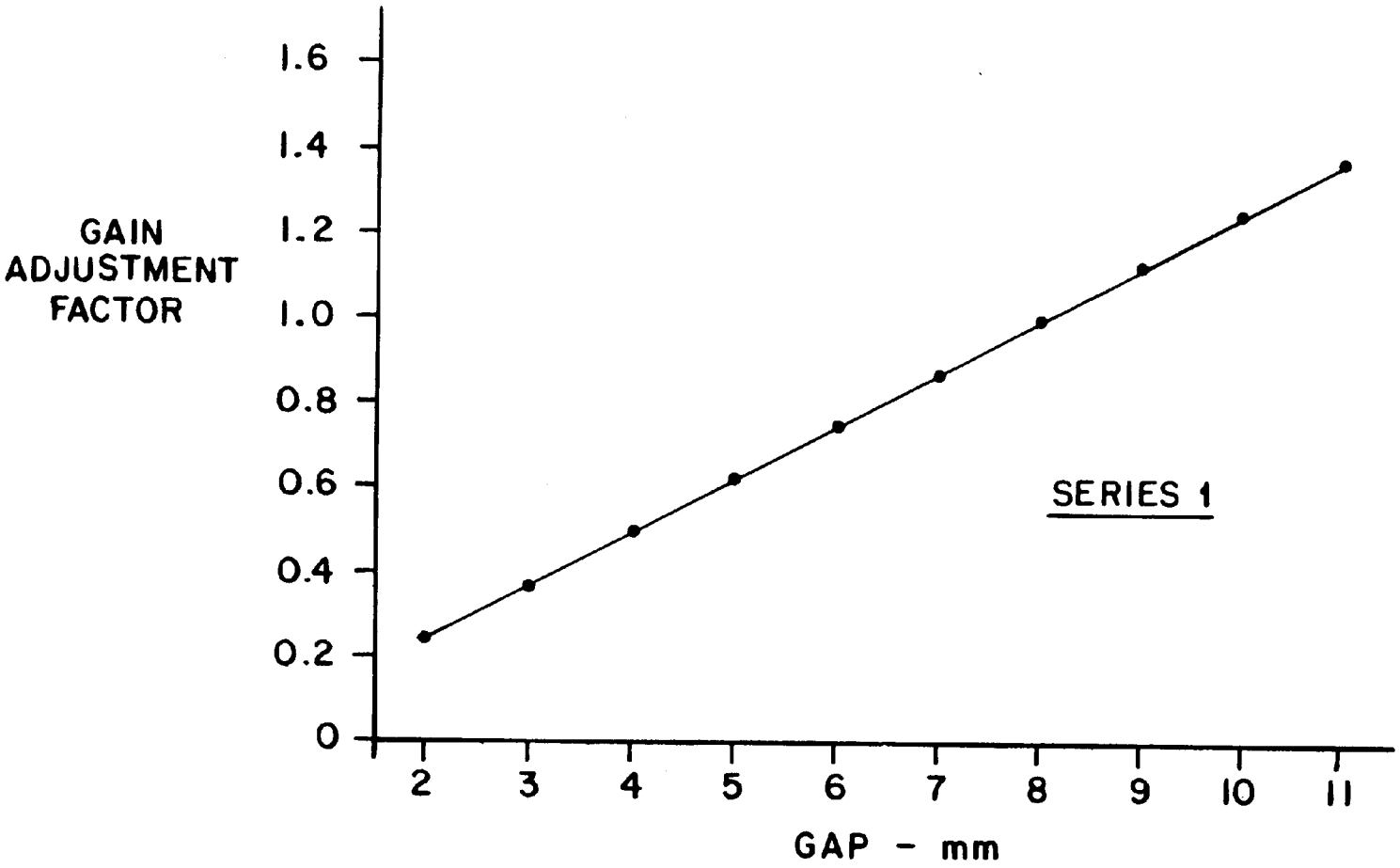
FIG. 6 shows a gain adjustment factor vs. gap, according to the invention.
Figure 7:
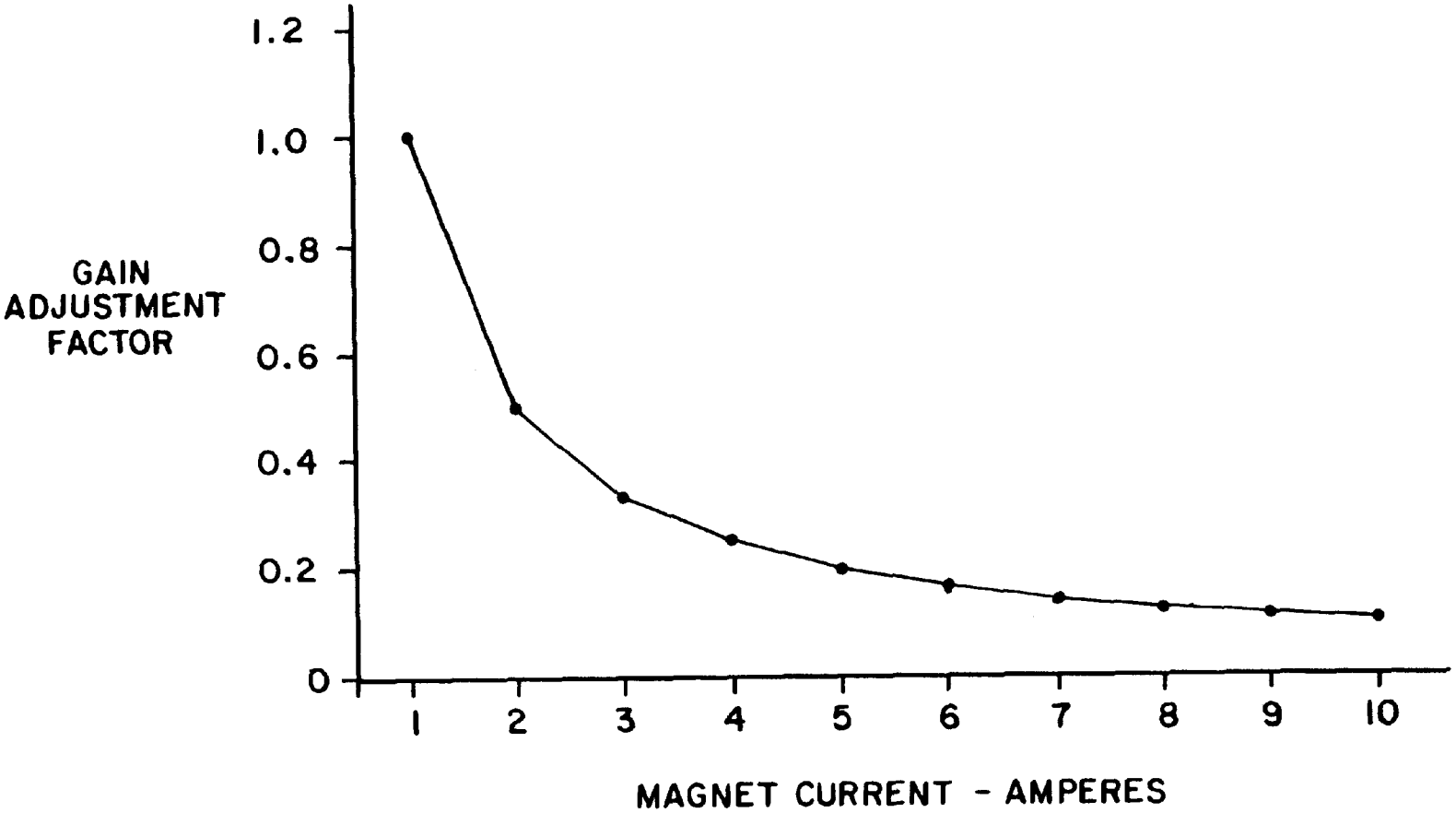
FIG. 7 shows a gain adjustment factor vs. electromagnet coil current, according to the invention.

FIG. 6 shows the gain adustment factor for varying gap. FIG. 7 shows the gain adjustment for varying current. It should be realized that other ways to accomplish similar results can also be carried out, this being but one example.

Figure 4:
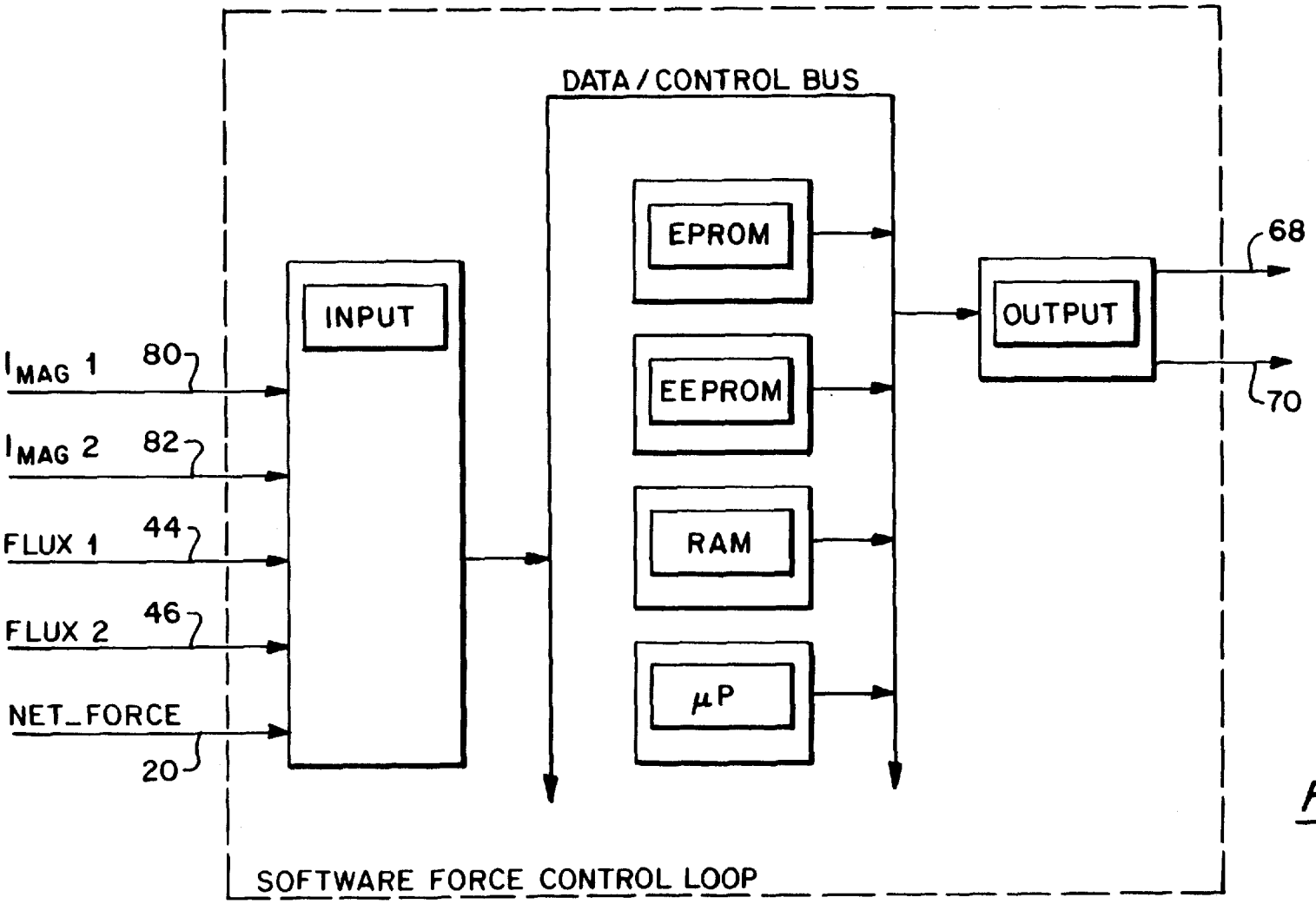
FIG. 4 shows a signal processor which may be used to carry out some or all of the functions of the software force control loop of FIG. 3, such as shown by the flow chart of FIG. 5.

FIG. 4 provides a block diagram of the controller hardware for the dual force loop. The $\mu$P samples the inputs and stores the input samples in RAM by executing instructions out of EPROM. Filter parameters are stored in EEPROM or EPROM for use in the lag compensation filters and the AGC logic. The resulting magnet PWM commands are sent to the magnet driver circuits.

Figure 5:
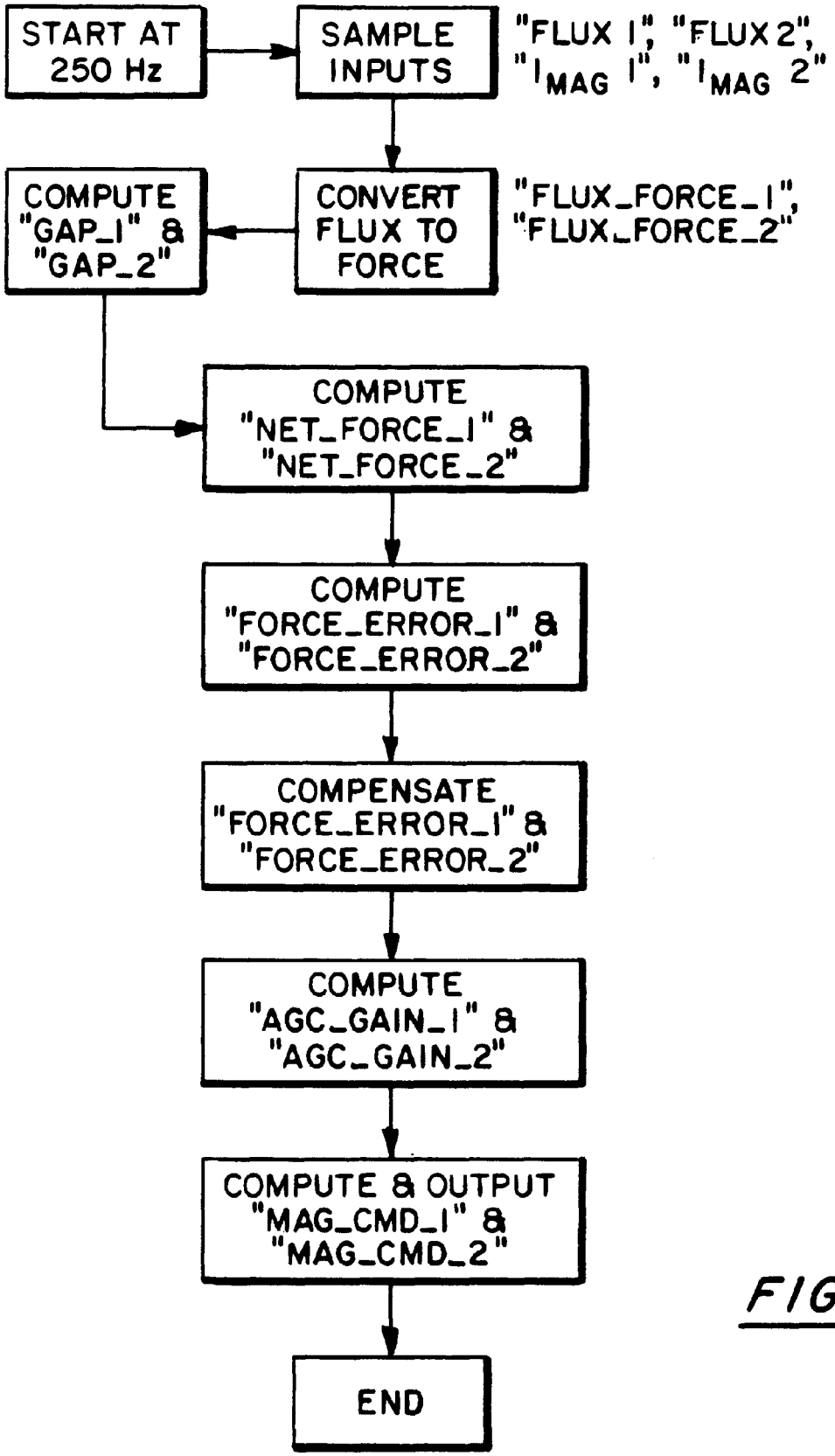
FIG. 5 is a flow chart illustration a series of steps which may be carried out in the signal processor of FIG. 4.

FIG. 5 illustrates a simplified software flow diagram for the dual force loop controller. The calculations are executed sequentially at the indicated rate.

Although the invention has been shown and described with respect to a preferred embodiment thereof it will be understood by those skilled in the art that the foregoing and various other changes, omissions and deviations in the form and detail thereof may be made therein without departing from the spirit and scope of this invention.

We claim:

1. A control for controlling a magnetic actuator for an elevator active suspension, said magnetic actuator responsive to a drive current from a magnet driver in response to a magnet command signal from said control, wherein said control is responsive to a force command signal, a sensed magnetic flux signal indicative of magnetic flux in an airgap of said magnetic actuator and to a sensed drive current signal for providing said magnet command signal, wherein said control comprises:

a summer, responsive to a force feedback signal having a magnitude indicative of force exerted by said magnetic actuator and responsive to said force command signal, for providing a force error signal;

a compensator, responsive to said error signal and to an automatic gain control signal, for providing said magnet command signal;

an automatic gain control, responsive to said force feedback signal or said sensed magnetic flux signal and to said sensed drive current signal, for providing said automatic gain control signal; and a flux-to-force converter, responsive to said sensed magnetic flux signal, for providing said force feedback signal.

2. The control of claim 1, wherein said compensator includes an adaptive proportional gain which is reduced as said sensed drive current signal increases in magnitude.

3. The control of claim 2, wherein said automatic gain control means is also responsive to said force feedback signal or said sensed magnetic flux signal for determining the magnitude of said airgap, wherein said adaptive proportional gain is increased as said airgap signal increases in magnitude.

* * * * *